US006117191A

United States Patent [19]

McNamee

[11] Patent Number: 6,117,191

[45] Date of Patent: Sep. 12, 2000

[54] DYE SCAVENGING SUBSTRATE, AND A METHOD FOR ITS MANUFACTURE

[75] Inventor: Patrick McNamee, Rochestown, Ireland

[73] Assignee: Little Island Patents, Mayfield, Ireland

[21] Appl. No.: 09/214,013

[22] PCT Filed: Jun. 19, 1997

[86] PCT No.: PCT/IE97/00042

§ 371 Date: Dec. 21, 1998

§ 102(e) Date: Dec. 21, 1998

[87] PCT Pub. No.: WO97/48789

PCT Pub. Date: Dec. 24, 1997

[30] Foreign Application Priority Data

Jun. 19, 1996 [IE] Ireland ..... S960456

[51] Int. Cl.[7] ..... D06M 13/328; D06M 13/385

[52] U.S. Cl. ..... 8/188; 8/606

[58] Field of Search ..... 8/606, 188

[56] References Cited

U.S. PATENT DOCUMENTS

| | | |
|---|---|---|
| 3,778,225 | 12/1973 | Cuvelier et al. . |
| 4,072,464 | 2/1978 | Balland . |
| 4,380,453 | 4/1983 | Claiborne . |
| 5,489,313 | 2/1996 | Hall et al. . |
| 5,667,533 | 9/1997 | Hauser et al. . |
| 5,881,412 | 3/1999 | Ziskind . |

FOREIGN PATENT DOCUMENTS

| | | |
|---|---|---|
| 0007135 A1 | 1/1980 | European Pat. Off. . |
| 0264831 A1 | 4/1988 | European Pat. Off. . |
| PCT/US93/ 10451 A1 | 5/1994 | WIPO . |

*Primary Examiner*—Margaret Einsmann

*Attorney, Agent, or Firm*—Hopgood, Calimafde, Kalil & Judlowe

[57] ABSTRACT

A method for the production of a dye scavening substrate which comprises the steps of: (a) providing a cellulosic substrate; (b) passing the substrate through a bath containing an alkaline solution of an N-trisubstituted ammonium 2-hydroxy-3-halopropyl compound having general formula (I) or a salt of epoxy propyl ammonium having general formula (II), wherein X is a halogen radical, Y is a chloride, bromide, sulfate or sulfonate, and the R's are methyl, ethyl, butyl or benzyl groups or an hydroxyl substituted derivative thereof; (c) subjecting the substrate to a pressure of between 0.69–1.37 MPa (100–200 psi); (d) heating the substrate to a temperature of approximately 35° C.; (e) wrapping the substrate in a water impermeable material and rotating the material at a temperature of between 15° C. and 100° C. for a period of between 1 hour and 12 hours; (f) removing the water impermeable material and passing the substrate through an acid bath; (g) subjecting the substrate to a pressure of between 1.03–1.72 MPa (150–250 psi); and (h) drying the substrate.

37 Claims, 3 Drawing Sheets

DYE SCAVENGING SUBSTRATE, AND A METHOD FOR ITS MANUFACTURE

Figure 1:
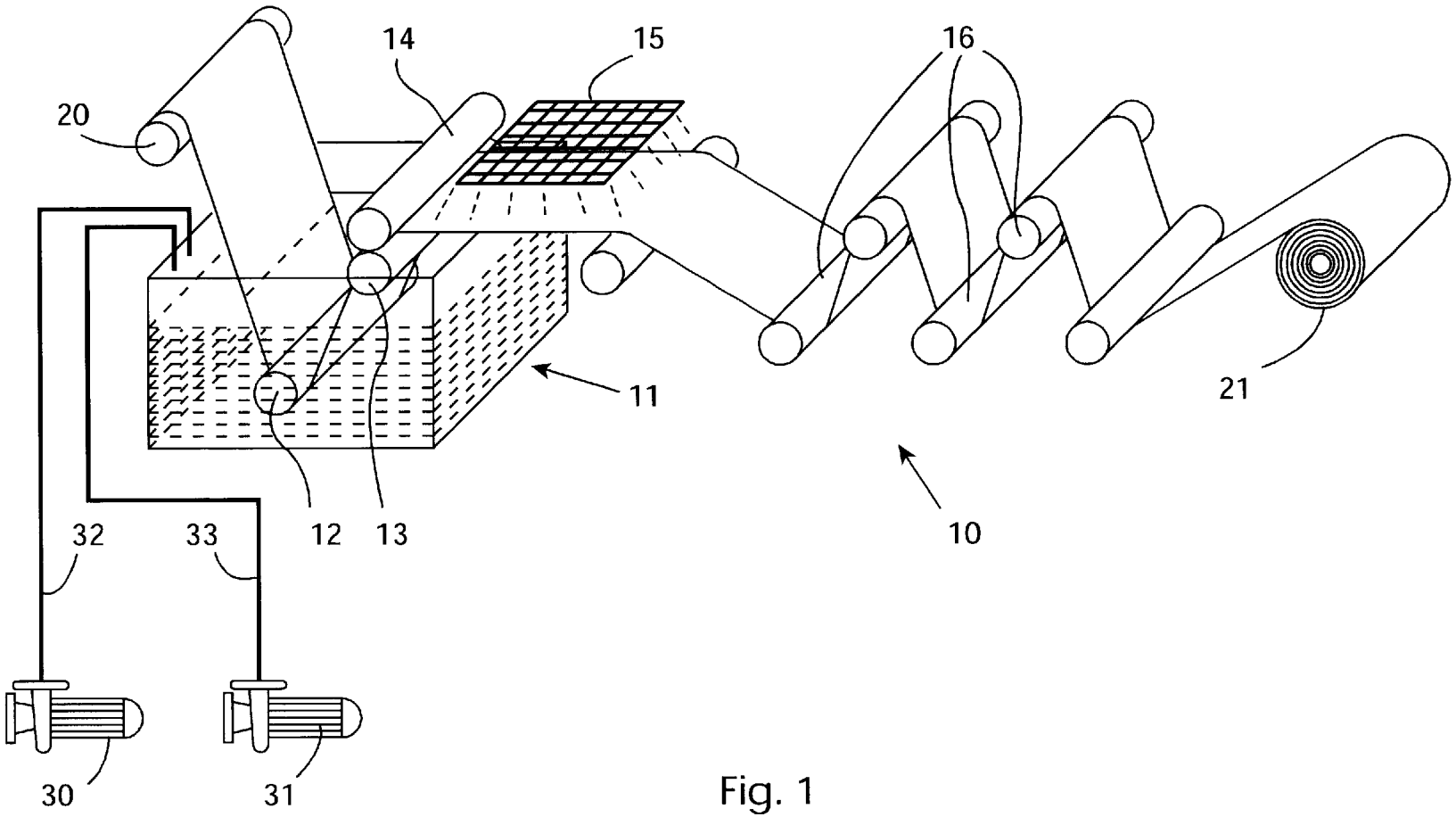

This invention relates to a dye scavenging substrate, and to a method for its manufacture.

In U.S. Patent Specification No. U.S. Pat. No. 4,380,453 to Claiborne, there is disclosed a system for removing undesirable random free-flowing dye from baths containing other materials to which association of such random dyes is undesirable.

The Specification discloses a method for the production of a dye scavenging substrate or cloth and to a method for its use.

The problems which the present invention serves to solve are conveniently provided in the Claiborne Specification. These problems, as outlined in Claiborne primarily relate to fading in home and commercial laundries. This problem has plagued housewives and businessmen for a considerable period of time.

It is well known that a typical mix of materials being laundered will have somewhat different colours, even if sorted into the so-called "white" and "coloured" batches. Although fading of dyes is more prevalent from new, unlaundered, or heretofore infrequently laundered goods, even articles with considerable fastness to washing, or having a long history of numerous previous launderings, may continue to bleed small amounts of dyestuff or colorant into the bath or wash water. The well known, but aggravating and undesirable result of such fading is that at least part of the extraneous, free flowing colorant or dyestuff which has bled from its original material substrate may then be absorbed, adsorbed, reacted with, or otherwise physically deposited on or associated with other materials in the same bath or wash water, thus discolouring this latter item.

While prior attempts to solve this problem have primarily been directed toward making the dyes or colorants have greater affinity for their original material substrate, the present invention is directed to a different aspect of the problem, namely effectively eliminating dyestuffs or colorants which have bled from or faded from the original material upon which they entered the bath or wash water environment. More specifically, the present invention is directed to a dye scavenging member or cloth; and the methods by which such a dye scavenging cloth or substrate is manufactured.

While the substrate of Claiborne has, experimentally, been found to scavenge dyes, it has also been found that it is only capable of scavenging relatively minor colour runs. Furthermore, the production of the Claiborne substrate has been found to be very cumbersome and tedious as the substrate or cloth must be stored for over twelve hours. In addition, contrary to what is taught in the Specification, it has been found that the cloth is not particularly suitable for repeated use. In addition, the production costs are relatively high.

It is an object of the present invention to provide a more economical production method and to provide an improved substrate.

The invention, therefore, provides a method for the production of a dye scavenging substrate which comprises the steps of:—

(a) providing a cellulosic substrate;

(b) passing the substrate through a bath containing an alkaline solution of an N-trisubstituted ammonium 2-hydroxy-3-halopropyl compound having the general formula:

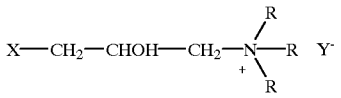

or a salt of epoxy propyl ammonium having the general formula:

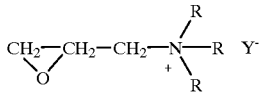

wherein X is a halogen radical, Y is a chloride, bromide, sulfate or sulfonate, and the R's are methyl, ethyl, butyl or benzyl groups or an hydroxyl substituted derivative thereof;

(c) subjecting the substrate to a pressure of between 0.69–1.37 MPa (100–200 psi);

(d) heating the substrate to a temperature of between approximately 30° C. and 40° C.;

(e) wrapping the substrate in a water impermeable material and rotating the material at a temperature of between 15° C. and 100° C. for a period of between 1 hour and 12 hours;

(f) removing the water impermeable material and passing the substrate through an acid bath;

(g) subjecting the substrate to a pressure of between 1.03–1.72 Mpa (150–250 psi); and (h) drying the substrate.

Preferably, the compound, which is a dye scavenging material, is glycidyltrimethylammonium chloride.

Preferably, the alkaline solution is at a temperature of between 30° C. and 50° C. most preferably approximately 45° C.

Preferably, the cellulosic material is a textile material which may take any form such as a woven, non-woven, or knitted fabric, a braided rope or bail or any other desirable configuration. The cellulosic material may be paper or may be a naturally occurring material such as cotton or an artificially produced material.

A particularly preferred material is a blend of viscose and cotton. Preferably, the ratio of viscose to cotton is in the range 90:10 to 10:90. Most preferably, the cellulosic material is a 50:50 blend of viscose and cotton.

Preferably, the pressure of step (c) is obtained by passing the substrate between a pair of hydraulically actuated rollers.

Preferably, heating of the substrate in step (d) is achieved by passing the substrate through a series of rollers having a temperature of approximately 100° C. so that the substrate exiting the rollers is at a temperature of between 30° C. and 40° C., preferably about 35° C.

Preferably, the temperature in step (e) is approximately 100° C. with a storage time of approximately 1 hour.

Preferably, the pressure in step (g) is approximately 1.38 MPa (200 psi) and the material is passed through the rollers at between 92 $mms^{-1}$ and 75 $mm.s^{-1}$, preferably approximately 83 $mm.s^{-1}$.

Preferably the drying temperature in step (h) is between 95° C. and 115° C., most preferably about 105° C.

Figure 2:
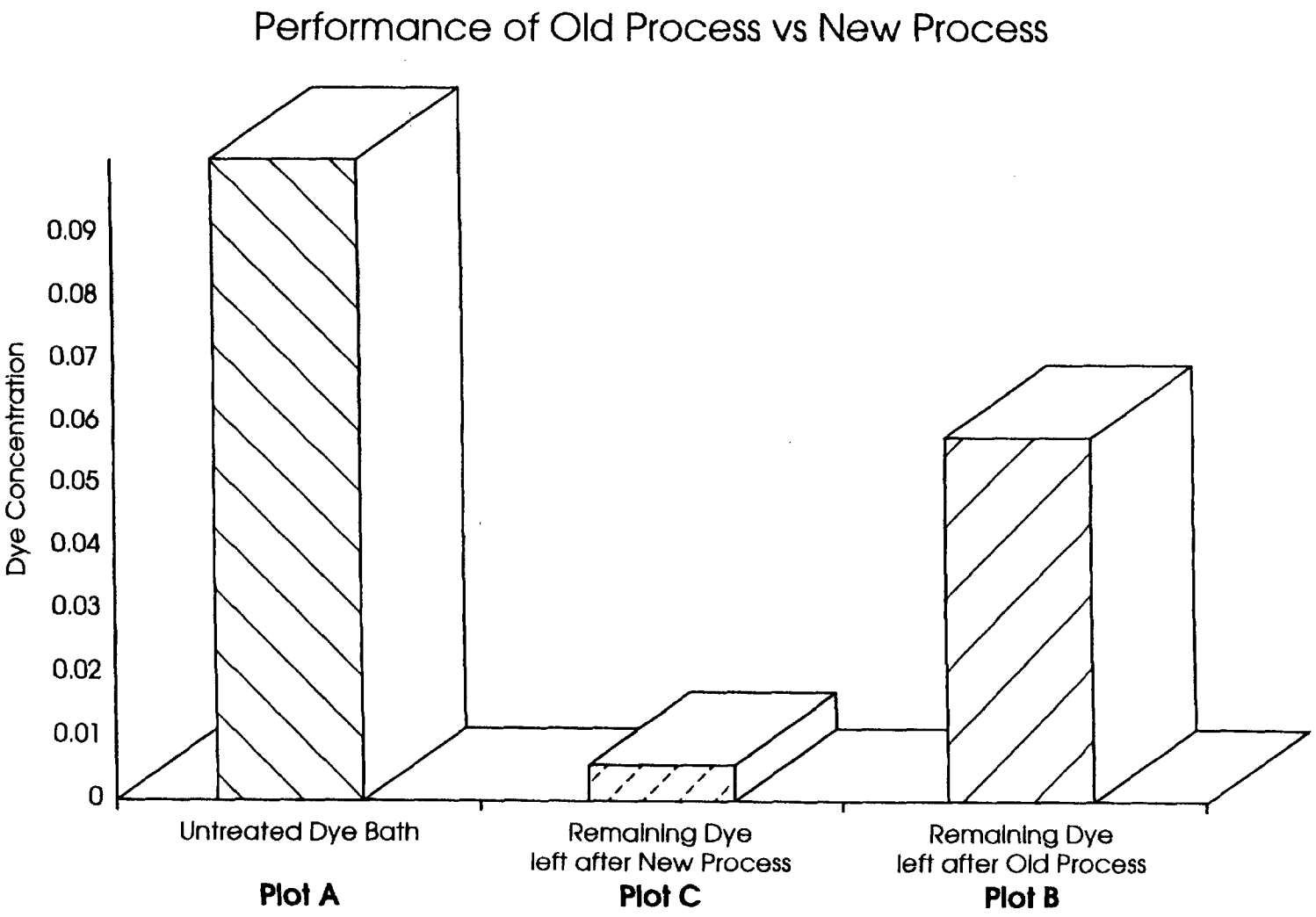
Figure 3:
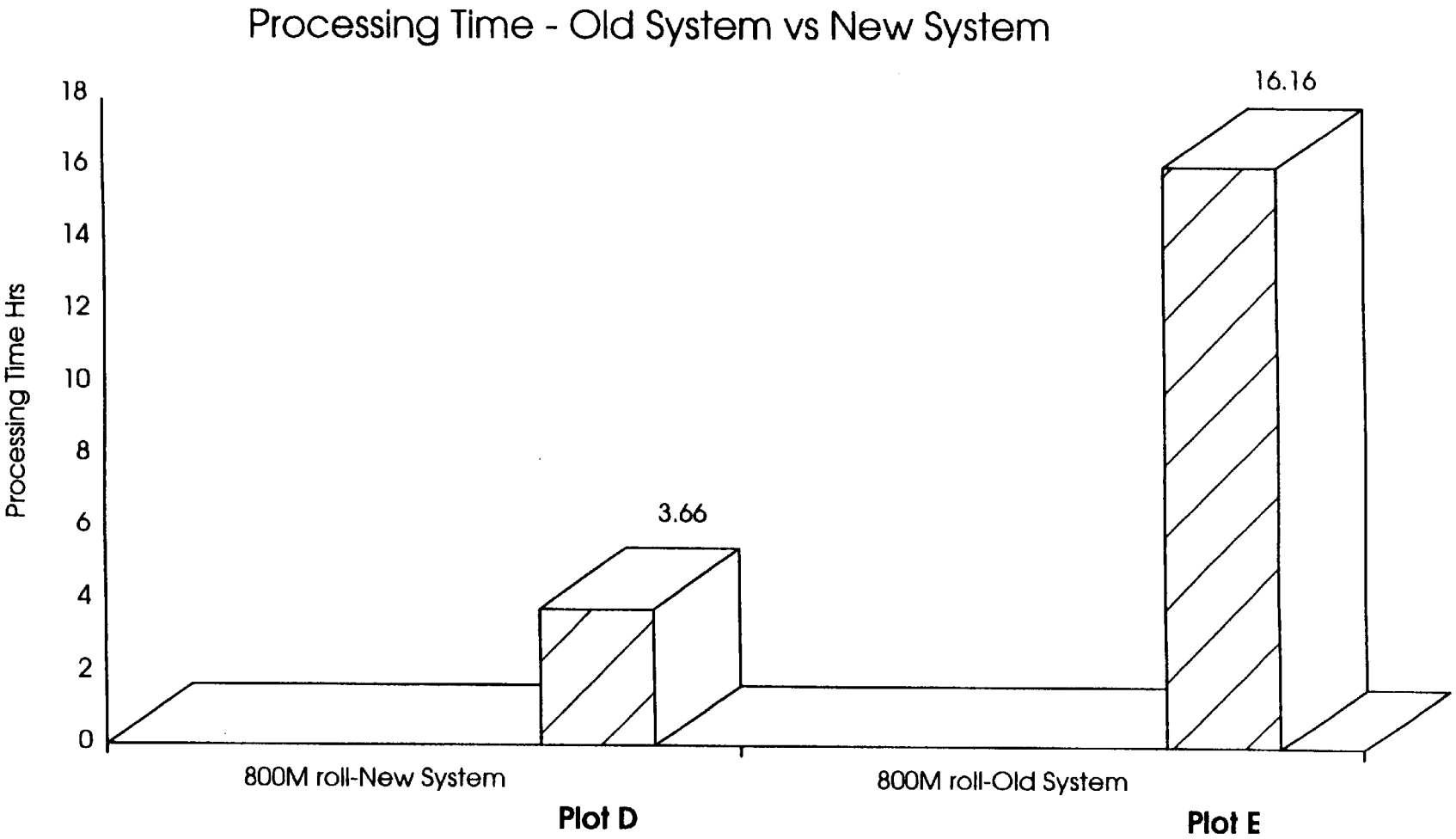

The invention will be understood in greater detail from the following description of a preferred embodiment thereof given by way of example and with reference to the accompanying drawings in which:

FIG. 1 is a schematic view of an apparatus for use in the method of production of the substrate according to the invention;

FIG. 2 shows a comparison between the dye concentration remaining in an untreated bath, (plot A) compared with the dye remaining using a substrate prepared in accordance with the Claiborne Patent Specification (Plot B) and compared with a substrate prepared in accordance with the present Specification Plot C; and FIG. 3 shows a comparison between the hours required to prepare an 800 m roll of substrate in accordance with a known teaching (Plot E) compared with the present Specification (Plot D).

Referring now to the drawings, there is shown an apparatus 10 for use in the production of the substrate which comprises a bath 11 containing a roller 12; a pair of hydraulically operated rollers 13,14; an infra-red drying unit 15; and a series of rollers 16.

A roll of substrate 20 is loaded onto a roller bar (not shown) for a first pass through the apparatus 10 and the material is fed into the bath 11 so as to pass beneath the roller 12, out of the bath 11 to between the rollers 13,14 and through the series of rollers 16 along a convoluted pathway to finally emerge therefrom and be taken up by a take-up roller (not shown) so as to provide a treated substrate roll 21. The rollers 13, 14 are set to provide a pressure of about 1.03 MPa (150 psi).

By means of pumps 30,31 the bath 11 is charged with a caustic solution via a line 32 and charged with dye scavenging material via line 33. The infra-red drying unit 15 is not used. The series of rollers 16 are heated to a temperature of approximately 100° C.

The treated substrate roll 21 is removed and wrapped in a water impermeable material and stored. The storage time depends on the storage temperature which will be discussed in more detail later in the Specification.

Following storage, the treated substrate roll 21 is again loaded onto the roller bar for a second pass and the material is fed into the bath 11 so as to pass beneath the roller 12; out of the bath 11 to between the rollers 13,14 and under the now in-use infra-red drying unit 15 and through the series of rollers 16 along a convoluted pathway to finally emerge and be taken up by the take-up roller. The thus produced substrate is now stored and cut into appropriate size pieces.

It will be appreciated that the apparatus 10 may comprise two in number so as to provide a system in which the first pass and the second pass may be carried in a continuous (rather than by a batch) process with suitably arranged equipment disposed between each apparatus for enabling the material to be stored for the required time.

The dye scavenging material comprises a compound from the group consisting of:

an N-trisubstituted ammonium 2-hydroxy-3-halopropyl compound having the general formula:

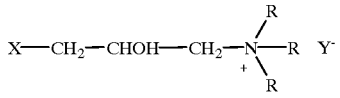

or a salt of epoxy propyl ammonium having the general formula:

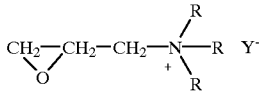

wherein X is a halogen radical, Y is a chloride, bromide, sulfate or sulfonate, and the R's are the same or different and are methyl, ethyl, butyl or benzyl groups or an hydroxyl substituted derivative thereof.

A most preferred compound is glycidlytmethylammonium chloride. The substrate roll comprises a cellulosic material.

Preferably, the cellulosic material is a textile material which may take any form such as a woven, non-woven, or knitted fabric, a braided rope or bail or any other desirable configuration. The cellulosic material may be paper or may be a naturally occurring material such as cotton or an artificially produced material.

Preferably, the cellulosic material may incorporate a binder such as polyvinylacetate. The cellulosic material may be viscose, cellulose or a mixture of cellulose and viscose.

A particularly preferred material is a blend of viscose and cotton. Preferably, the ratio of viscose to cotton is in the range 90:10 to 10:90. Most preferably, the cellulosic material is a 50:50 blend of viscose and cotton together with a binder such as polyvinylacetate.

The substrate material in the first pass through the apparatus 10 moves at a rate of between 184 $mm.s^{-1}$ and 167 $mm.s^{-1}$, preferably 175 $mm.s^{-1}$.

The substrate material in the second pass through the apparatus 10 moves at the rate of between 92 $mm.s^{-1}$ and 75 $mm.s^{-1}$, preferably 83 $mm.s^{-1}$.

The caustic solution for use in the preparation of the alkaline solution comprises water and NaOH (pearl) in a range of from 5% NaOH to 50% NaOH or 2–10% NaOH or 5–10% NaOH and preferably either approximately 5% NaOH or approximately 4.7% NaOH. In the bath 11, the caustic solution and the compound are present in a ratio of between 1:0.119 to 1:0.26, preferably approximately 1:0.23. The temperature of the solution is preferably about 45° C.

The acid solution comprises HCl in the range 4.3M–5M, preferably either approximately 5M or approximately 4.7M. In the bath 11 the ratio of water to acid is 1:0.032 to 1:0.053 and preferably about 1:0.042 or most preferably about 1:0.026.

The acid solution may also contain a perfume and/or a non-ionic surfactant ethoxylated fatty alcohol agent such as Volpo L4. Alternatively, where the acid solution does not contain the additions referred to, the substrate material may subsequently be treated in water containing a perfume and/or a non-ionic surfactant ethoxylated fatty alcohol agent.

EXAMPLE

A roll of substrate comprising a 50:50 ratio of cotton:viscose was treated in a first pass through the apparatus 10 at a rate of approximately 175 $mm.s^{-1}$. The temperature of the rollers 16 was approximately 100° C. and the exiting temperature of the substrate was approximately 35° C. The pressure of the rollers 13, 14 was approximately 1.03 MPa (150 psi). The substrate was stored for one hour at 100° C. rotating continuously. Subsequently, the substrate was treated in a second pass with the rollers 13, 14 operating at approximately 1.37 MPa (200 psi), the infra red heater 15 operating atapproximately 286° C. to dry the material and the rollers 16 operating at approximately 100° C.

The alkaline solution in the bath 11 during the first pass comprised 81.55% caustic solution and 18.45% glycidyltrimethylammonium chloride.

The acid solution in the bath 11 during the second pass comprised 95.6% water, 4.0% of HCl in the range 4.3M–5.0M preferably 4.7M, 0.30% of perfume (Fresh Linen) and 0.10% of Volpo L4.

The chart in FIG. 2 shows a comparison between the dye concentration remaining in an untreated bath, (plot A) compared with the dye remaining using a substrate prepared in accordance with the Claiborne Patent Specification (Plot B) and compared with a substrate prepared in accordance with the present Specification Plot C. Dye concentration is expressed in $g.l^{-1}$.

The chart in FIG. 3 shows a comparison between the hours required to prepare an 800 m roll of substrate in accordance with the teaching of the Claiborne Specification (Plot E) compared with the present Specification (Plot D).

The resulting substrate is suitable for use in commercial and domestic laundry environments for the purpose of removing undesirable free-flowing dyes from the laundry wash water thus eliminating undesirable discolouration of some clothes by fading of dyes from others.

What is claimed is:

1. A method for the production of a dye scavenging substrate which comprises the'steps of:—

(a) providing a cellulosic substrate;

(b) passing the substrate through a bath containing an alkaline solution of an N-trisubstituted ammonium 2-hydroxy-3-halopropyl compound having the general formula:

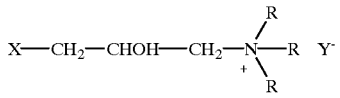

or a salt of epoxy propyl ammonium having the general formula:

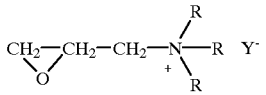

wherein X is a halogen radical, Y is a chloride, bromide, sulfate or sulfonate, and the R's are methyl, ethyl, butyl or benzyl groups or an hydroxyl substituted derivative thereof;

(c) subjecting the substrate to a pressure of between 0.69–1.37 MPa (100–200 psi);

(d) heating the substrate to a temperature of between 30° C. and 40° C.;

(e) wrapping the substrate in a water impermeable material and rotating the material at a temperature of between 15° C. and 100° C. for a period of between 1 hour and 12 hours;

(f) removing the water impermeable material and passing the substrate through an acid bath;

(g) subjecting the substrate to a pressure of between 1.03–1.72 Mpa (150–250 psi); and h) drying the substrate.

2. A method as claimed in claim 1 wherein the compound is glycidyl-trimethylammonium chloride.

3. A method as claimed in claim 1 wherein the alkaline solution is at a temperature of between 30° C. and 50° C.

4. A method as claimed in claim 3 wherein the alkaline solution is at a temperature of about 45° C.

5. A method as claimed in claim 1 wherein the cellulosic material is a textile material which may take any form selected from a woven, non-woven, or knitted fabric, a braided rope or bail or any other desirable configuration.

6. A method as claimed in claim 1 wherein the cellulosic material is paper (a) (b) cotton (c) viscose, or a mixture of (b) and (c).

7. A method as claimed in claim 1 wherein the cellulosic material incorporates a binder.

8. A method as claimed in claim 1 wherein the material is a blend of viscose and cotton.

9. A method as claimed in claim 8 wherein the ratio of viscose to cotton is in the range 90:10 to 10:90.

10. A method as claimed in claim 8 wherein the cellulosic material is a 50:50 blend of viscose and cotton.

11. A method as claimed in claim 9 wherein the pressure of step (c) is obtained by passing the substrate between a pair of hydraulically actuated rollers.

12. A method as claimed in claim 1 wherein the pressure employed in step (c) is about 1.03 MPa (150 psi).

13. A method as claimed in claim 11 wherein the material passes between the rollers at a rate of between 184 $mm.s^{-1}$ and 167 $mm.s^{-1}$.

14. A method as claimed in claim 12 wherein the material passes between the rollers at about 175 $mm.s^{-1}$.

15. A method as claimed in claim 1 wherein heating of the substrate in step (d) is achieved by passing the substrate through a series of rollers having a temperature of 100° C. so that the substrate exiting the rollers is at a temperature of between 30° C. and 40° C.

16. A method as claimed in claim 15 wherein the substrate exiting the roller is at approximately 35° C.

17. A method as claimed in claim 1 wherein the temperature in step (e) is 100° C. with a storage time of 1 hour.

18. A method as claimed in claim 1 wherein the pressure in step (g) is approximately 1.38 MPa (200 psi).

19. A method as claimed in claim 18 wherein the material passes between the rollers at a rate of between 92 $mms^{-1}$ and 75 $mm.s^{-1}$.

20. A method as claimed in claim 19 wherein the material passes between the rollers at a rate of approximately 83 $mm.s^{-1}$.

21. A method as claimed in claim 1 wherein the drying temperature in step (h) is between 95° C. and 115° C.

22. A method as claimed in claim 21 wherein the drying temperature in step (h) is approximately 105° C.

23. A method as claimed in claim 1 wherein the caustic solution for use in the preparation of the alkaline solution comprises water and NaOH (pearl) in a concentration of from 5% NaOH to 50% NaOH.

24. A method as claimed in claim 1 wherein the caustic solution for use in the preparation of the alkaline solution comprises water and NaOH (pearl) in a concentration of from 2% NaOH to 10% NaOH.

25. A method as claimed in claim 23 wherein the caustic solution for use in the preparation of the alkaline solution comprises water and NaOH (pearl) in a concentration of from 5% NaOH to 10% NaOH.

26. A method as claimed in claim 25 wherein the caustic solution for use in the preparation of the alkaline solution comprises water and NaOH (pearl) in a concentration of approximately 5% NaOH.

27. A method as claimed in claim 1 wherein the caustic solution for use in the preparation of the alkaline solution comprises water and NaOH (pearl) in a concentration of approximately 4.7% NaOH.

28. A method as claimed in claim 1 wherein the alkaline solution comprises the caustic solution and the compound in a ratio range of between 1:0.119 to 1:0.26.

29. A method as claimed in claim 28 wherein the alkaline solution comprises the caustic solution and the compound in a ratio of approximately 1:0.23.

30. A method as claimed in claim 29 wherein the alkaline solution comprises 81.55% caustic solution and 18.45% glycidyltrimethylammonium chloride.

31. A method as claimed in claim 1 wherein the acid solution comprises water and HCl, the HCl being in the range of 4.3M to 5.0M.

32. A method as claimed in claim 31 wherein the acid solution comprises water and approximately 5M HCl.

33. A method as claimed in claim 31 wherein the acid solution comprises water and approximately 4.7M HCl.

34. A method as claimed in claim 1 wherein the acid solution comprises water and HCl in a ratio range of from 1:0.032 to 1:0.053.

35. A method as claimed in claim 34 wherein the acid solution comprises water and approximately 5M HCl in a ratio of approximately 1:0.042.

36. A method as claimed in claim 1 wherein the acid solution comprises water and HCl in a ratio of approximately 1:0.026.

37. A method as claimed in claim 1 wherein the acid solution also contains a perfume and a non-ionic surfactant ethoxylated fatty alcohol agent.

* * * * *